US009941027B2

(12) United States Patent
Kral et al.

(10) Patent No.: US 9,941,027 B2
(45) Date of Patent: Apr. 10, 2018

(54) PROCESS AND INSTALLATION FOR PRODUCING RADIOISOTOPES

(71) Applicant: Ion Beam Applications S.A., Louvain-la-Neuve (BE)

(72) Inventors: Eric Kral, Waterloo (BE); Xavier Wilputte, Ressaix (BE); Michel Ghyoot, Walhain (BE); Jean-Michel Geets, Couthuin (BE)

(73) Assignee: ION BEAM APPLICATIONS S.A., Louvain-la-Neuve (BE)

( * ) Notice: Subject to any disclaimer, the term of this patent is extended or adjusted under 35 U.S.C. 154(b) by 979 days.

(21) Appl. No.: 14/350,524

(22) PCT Filed: Oct. 10, 2012

(86) PCT No.: PCT/EP2012/070013

§ 371 (c)(1),
(2) Date: Apr. 8, 2014

(87) PCT Pub. No.: WO2013/064342

PCT Pub. Date: May 10, 2013

(65) Prior Publication Data

US 2014/0376677 A1 Dec. 25, 2014

(30) Foreign Application Priority Data

Oct. 10, 2011 (BE) ..... 11184551

(51) Int. Cl.
*G21G 1/10* (2006.01)

(52) U.S. Cl.
CPC ..... *G21G 1/10* (2013.01)

(58) Field of Classification Search
CPC .... G21G 1/00; G21G 1/10; G21G 2001/0015; G21K 5/00; G21K 1/00; H05H 5/03
(Continued)

(56) References Cited

U.S. PATENT DOCUMENTS 4,055,463 A * 10/1977 Torres ..... G21D 3/12 376/217
4,179,100 A * 12/1979 Sashin ..... A61B 6/02 250/366

(Continued)

FOREIGN PATENT DOCUMENTS

EP 2146555 A1 * 1/2010 ..... H05H 6/00
JP 2009103611 A 5/2009
WO 2010007174 A1 1/2010

OTHER PUBLICATIONS

Casella, V., et al. "Anhydrous F-18 labeled elemental fluorine for radiopharmaceutical preparation." Journal of nuclear medicine: Society of Nuclear Medicine 21.8 (1980): 750-757. <www.researchgate.net/publication/15797932_Anhydrous_F-18_labeled_elemental_fluorine_for_radiopharmaceutical_preparation>.*

(Continued)

*Primary Examiner* — Jack W Keith
*Assistant Examiner* — Lily C Garner
(74) *Attorney, Agent, or Firm* — Fitch, Even, Tabin & Flannery LLP

(57) ABSTRACT

The invention relates to a method for producing a radioisotope, which method comprises irradiating a volume of radioisotope-precursor fluid contained in a sealed cell of a target using a beam of particles of a given current, which beam is produced by a particle accelerator. The target is cooled and the internal pressure in the sealed cell is measured. During the irradiation, the internal pressure (P) in the sealed cell is allowed to vary freely. The irradiation is interrupted or its intensity is reduced when the internal pressure (P) in the sealed cell departs from a first tolerated range defined depending on various parameters that influence the variation in the internal pressure in the sealed cell during the irradiation. These parameters for example com- (Continued)

prise, for a given target, particle beam and radioisotope-precursor fluid: the degree of filling of the hermetic cell, the cooling power used to cool the given target, and the beam current (I). The invention also relates to an installation for implementing the method.

14 Claims, 2 Drawing Sheets

(58) Field of Classification Search
USPC ..... 376/194, 254
See application file for complete search history.

(56) References Cited

U.S. PATENT DOCUMENTS

| | | | | |
|---|---|---|---|---|
| 5,875,221 | A * | 2/1999 | Kreuter | G21C 7/00 376/215 |
| 2007/0040115 | A1 * | 2/2007 | Publicover | G01T 1/29 250/305 |
| 2007/0297554 | A1 | 12/2007 | Lavie et al. | |
| 2009/0274603 | A1 | 11/2009 | Steel et al. | |

OTHER PUBLICATIONS

International Search Report, International Application No. PCT/EP2012/070013, dated Jan. 8, 2013, 2 pages.

* cited by examiner

PROCESS AND INSTALLATION FOR PRODUCING RADIOISOTOPES

CROSS REFERENCE TO RELATED APPLICATIONS

This application is a national phase application of International Application No. PCT/EP2012/070013, filed Oct. 10, 2012, designating the United States and claiming priority to European Patent Application No. 11184551.7, filed Oct. 10, 2011, which is incorporated by reference as if fully rewritten herein.

TECHNICAL FIELD

The present invention concerns a method for producing a radioisotope and an installation for implementing this method.

STATE OF THE ART

In nuclear medicine, positron emission tomography is an imaging technique requiring positron-emitting radioisotopes or molecules labelled with these same radioisotopes. The $^{18}F$ radioisotope is one of the most frequently used radioisotopes. Other routinely used radioisotopes are: $^{13}N$; $^{15}O$; and $^{11}C$. The $^{18}F$ radioisotope has a half-life time of 109.6 min and can therefore be conveyed to sites other than its production site.

$^{18}F$ is most often produced in its ion form. It is obtained by bombarding protons accelerated onto a target comprising $^{18}O$-enriched water. Numerous targets have been developed, all having the same objective of producing $^{18}F$ in shorter time with better yield. In general, a device for producing radioisotopes comprises a proton accelerator and a target cooled by a cooling device. This target comprises a cavity hermetically sealed by a beam window to form a hermetic cell inside which a radioisotope precursor is contained in liquid or gas form.

In general, the energy of the proton beam directed onto the target is in the order of a few MeV to about twenty MeV. Said beam energy causes heating of the target and vaporisation of the liquid containing the radioisotope precursor. Since the vapour phase has lower stopping power, a larger quantity of particles in the radiation beam passes through the hermetic cell without being absorbed by the radioisotope precursor, which not only reduces the radioisotope production yield but also causes further heating of the target. This well-known phenomenon is commonly called the <<tunnelling effect>>.

It is known to reduce the magnitude of the tunnelling effect using a system to pressurise the hermetic cell as described for example in document WO2010007174. A said system pressurises the hermetic cell of the target with an inert gas so as to increase the evaporation temperature of the precursor liquid inside the hermetic cell. However this solution has the disadvantage of having to operate with a higher pressure inside the hermetic cell of the target, which requires a target designed to withstand higher pressures. A said target has the disadvantage of being provided with a wall of greater thickness than conventional targets. It therefore requires relatively high beam energy to irradiate the radioisotope precursor.

Document JP2009103611 describes a device for producing radioisotopes comprising a system to pressurise the hermetic cell that is capable of maintaining a constant internal pressure inside the hermetic cell. To prevent rupture of the beam window subsequent to an increase in pressure, document JP 2009103611 proposes equipping the hermetic cell with a control valve allowing controlled discharge of the radioisotope precursor fluid if the pressure inside the hermetic cell exceeds a threshold value. This solution has the disadvantage in particular of causing loss of volume of the radioisotope precursor fluid contained in the hermetic cell. Yet some radioisotope precursor fluids may be very costly which means that undue discharges must be avoided at all costs. To prevent undue discharges the working pressure inside the hermetic cell of the target must be substantially lower than the discharge pressure.

When the target intended for production of radioisotopes is daily irradiated by a proton beam for several hours, some regions of the target may become fragile over time. Heating of the irradiation cell may therefore damage seals sealing the cavity closed by the beam window, causing leakages. Leaks may also occur at the beam window. In addition, irradiation of the target produces secondary radiation which may damage neighbouring parts e.g. ducts, valves or pressure sensor equipping the target, also causing leaks. While the above-mentioned pressurising device has the advantage of maintaining the radioisotope precursor fluid in condensed or semi-condensed state, possible leaks in the irradiation cell and/or poor filling of the target due to a faulty valve for example cannot be detected in time. If the device monitoring internal pressure in the hermetic cell records a drop in this pressure, the pressurising device will normally inject inert gas into the target to re-increase its internal pressure. It is also to be noted that impurities resulting from washing of the target followed by incomplete drying may also cause overpressure, which may be masked by the above-mentioned pressurising device.

When an insufficiently filled target is irradiated, in addition to the poor radioisotope yield obtained, some parts of the target may rapidly become heated on account of the tunnelling effect, going as far as deforming the target, the seals or beam window. Leaks may occur without being detected in time on account of the pressurisation system which re-increases the internal pressure of the target when the pressure varies.

The greater the extent of filling of the hermetic cell with the radioisotope fluid precursor, the more the pressure inside the hermetic cell increases during irradiation. Yet if the internal pressure inside the hermetic cell exceeds a certain threshold, this may cause rupture of the beam window leading to extremely harmful consequences.

Therefore, not only must rupture of the beam window be prevented further to an increase in pressure, but leakage problems or inadequate filling must also be detected in time.

DESCRIPTION OF THE INVENTION

It is one objective of the present invention when producing radioisotopes to detect leakage problems or poor filling of a target in time, and to prevent deterioration of the target either via the said tunnelling effect or via an excessive increase in pressure.

This objective is reached with the method described in claims 1 et seq. or the installation described in claims 10 et seq.

More specifically, a method according to the invention comprises the steps known per se of irradiating a volume of radioisotope precursor fluid contained in a hermetic cell of a target, using a beam of particles of given current which is produced by a particle accelerator. The target is cooled and the internal pressure in the hermetic cell is measured.

According to one aspect of the invention, the internal pressure (P) in the hermetic cell is allowed to be freely established during irradiation, without endeavouring to control the pressure by injecting a pressurising gas and/or using a depressurising valve, and irradiation is interrupted or its intensity is reduced when the internal pressure (P) in the hermetic cell moves out of a first tolerance range which is defined in relation to different parameters having an influence on changes in internal pressure in the hermetic cell during irradiation. Said parameters, for a given target and given radioisotope precursor fluid, particularly comprise the extent of filling of the hermetic cell, the cooling power of the target and beam current intensity (I).

With this manner of operating, when the pressure falls below the lower limit of the first tolerance range, irradiation is interrupted or its intensity is reduced to avoid overheating the target. This lower limit corresponds to a difference that is too large compared with an optimal internal pressure determined for a hermetic cell containing a given volume of radioisotope precursor fluid and irradiated with a given beam current intensity.

When the pressure exceeds the upper limits of the first tolerance range, irradiation is interrupted or its intensity is reduced also to prevent rupture of the beam window due to an excessive increase in pressure in the hermetic cell. This upper limit can be defined so that it affords sufficient safety in relation to the rupture pressure of the beam window.

It will be appreciated that this manner of operating does not require any injection of a pressurising gas which would increase the total pressure inside the hermetic cell i.e. the nominal pressure designed for the target, and would also risk masking any leakages. Nor does it require depressurising via discharge causing loss of costly radioisotope precursor fluid.

To interrupt irradiation or to reduce the intensity thereof, it is normally acted directly on the particle accelerator. However, it is also possible to act on the beam of particles (for example by deflecting the beam or inserting an obstacle on its pathway), or on the target (for example by moving it away from the pathway of the beam of particles).

Preferably a curve P=f(I) is determined e.g. experimentally or using a mathematical model, giving the internal pressure (P) of the hermetic cell at different beam intensities (I), for a given target, a given volume of radioisotope precursor fluid and a given cooling power of the target. The first tolerance range then has a lower pressure limit and a higher pressure limit, defined for the given beam current intensity (I) on the basis of the curve P=f(I). The lower limit of internal pressure is defined so that it is lower, preferably between 5% and 20% lower, than the pressure value inferred from the said curve P=f(I) for the given beam intensity (I). The upper limit of internal pressure is a pressure between the pressure value inferred from the curve P=f(I) for the given beam intensity (I) and a nominal pressure value (Pmax) of the hermetic cell. This nominal pressure value (Pmax) is assumed to represent the maximum pressure value at which the hermetic cell is guaranteed.

The upper limit of internal pressure in the first tolerance range is advantageously lower by at least 20% than the nominal pressure value (Pmax) of the hermetic cell. This normally affords sufficient safety against rupture of the beam window.

Preferably, the upper limit of internal pressure in the first tolerance range is between 5 and 10 bars higher than the pressure value inferred from the curve P=f(I) for the given beam intensity (I) and its ceiling is a pressure value (P2) lower by a value of X bars than the nominal pressure value (Pmax) of the said hermetic cell. With this operating mode it is possible to detect poor filling of the hermetic cell or possible impurities derived from washing of the cell, and thereby to prevent too rapid rise in pressure when the beam intensity reaches high values.

A control device advantageously triggers an alarm when the internal pressure (P) in the said hermetic cell moves out of a second tolerance range determined for the said given beam current intensity (I), a given volume of radioisotope precursor fluid and a given cooling power of the said target, this second tolerance range being included in the first tolerance range. The operator is thus alerted to a change in pressure in the hermetic cell which soon risks causing interruption of irradiation, and can optionally still prevent this automatic interruption.

The second tolerance range has a lower pressure limit and a higher pressure limit, determined on the basis of the curve P=f(I), mentioned above. The lower limit of internal pressure in the second tolerance range is determined so that it is lower, preferably at least 2% lower, than the pressure value inferred from the said curve P=f(I) for the given beam current intensity (I) whilst remaining higher however than the lower limit of internal pressure in the first tolerance range. The upper limit of internal pressure in the second tolerance range is determined so that it is higher than the pressure value inferred from the curve P=f(I) for the given beam current intensity (I), whilst remaining lower than the upper limit of internal pressure in the first tolerance range.

When the internal pressure (P) in the hermetic cell exceeds an upper limit of internal pressure which is determined so that it is higher than the pressure value inferred from the said curve P=f(I) for the given beam intensity (I), but lower than the upper limit of internal pressure in the first tolerance range, advantageously the beam current is reduced. In this manner it is optionally still possible to interrupt irradiation.

The extent of filling of the hermetic cell is advantageously optimised so as to obtain a high yield of radioisotope production.

The radioisotope precursor is advantageously a precursor of $^{11}C$, $^{13}N$, $^{15}O$ or $^{18}F$.

An installation is also presented for the implementation of the above-described method. This installation comprises a target with a hermetic cell capable of containing a volume of precursor fluid, this hermetic cell being guaranteed to withstand a nominal pressure (Pmax), a particle accelerator capable of producing and directing a beam of particles of given intensity (I) onto the target, a system for monitoring the internal pressure of the hermetic cell, and a control device programmed to interrupt the particle beam or to reduce the intensity thereof when the internal pressure (P) in the hermetic cell moves out of a determined first tolerance range in relation to different parameters having an influence on pressure changes inside the hermetic cell during irradiation.

The control device is advantageously programmed to trigger an alarm when the internal pressure of the hermetic cell lies outside a second tolerance range included within the said first tolerance range.

The control device may also advantageously be programmed to cause a reduction in the intensity of the beam current when the internal pressure (P) in the said hermetic cell exceeds an upper limit of internal pressure.

In one preferred embodiment, the control device is programmed with a curve P=f(I) giving the internal pressure (P) of the hermetic cell at different beam current intensities (I), for a given volume of radioisotope precursor fluid and a given cooling power of the said target; this curve P=f(I)

being used by the said control device to determine the said first tolerance range as a function of beam current intensity (I).

BRIEF DESCRIPTION OF THE DRAWINGS

Other characteristics and advantages will become apparent from the detailed description of different embodiments of the invention described below by way of illustration, with reference to the appended drawings in which.

DESCRIPTION OF EMBODIMENTS OF THE INVENTION

Figure 1:
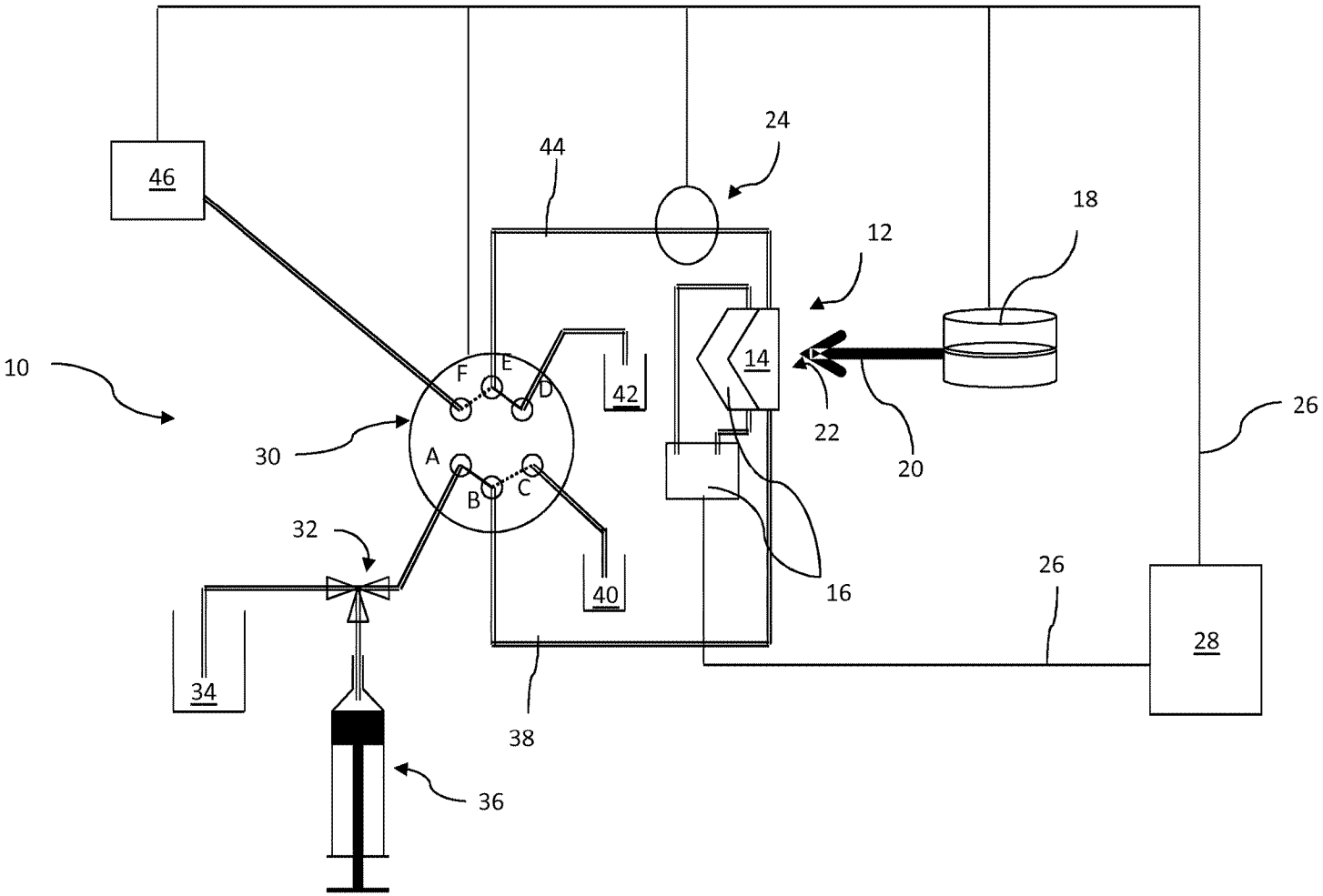
FIG. 1: is a schematic of an installation for producing radioisotopes according to the present invention.

One non-limiting embodiment of an installation 10 for producing radioisotopes according to the invention is illustrated on the basis of the schematic in FIG. 1. This installation 10 comprises a target, globally identified under reference number 12. This target 12 comprises a hermetic cell 14 containing a volume of radioisotope precursor fluid. As is known per se it is equipped with a cooling circuit 16.

The installation 10 further comprises a particle accelerator 18 capable of producing a beam 20 of accelerated particles, which is directed onto the target 12 to irradiate the radioisotope precursor in the hermetic cell 14. The beam 20 enters the hermetic cell 14 via a beam window 22 having a thickness in the order of a few tens of micrometers. The maximum internal pressure that can be withstood by the target 12 is dependent in particular on the thickness of this beam window. The term nominal pressure (Pmax) of the target 12 is given to the maximum internal pressure in the hermetic cell 14 guaranteed by the manufacturer of the target. For as long as the internal pressure in the hermetic cell 14 remains lower than the nominal pressure (Pmax), it is guaranteed by the target manufacturer that the beam window 22 will be pressure-resistant. This nominal pressure (Pmax) is evidently a function of the geometry of the hermetic cell 14.

The reference number 24 denotes a schematic illustration of a pressure sensor which measures the internal pressure inside the hermetic cell 14. A signal representing this measured pressure is transmitted via a data bus 26 for example to a control device 28. On the basis of this pressure signal, the control device 28 monitors the pressure inside the hermetic cell 14 continuously or almost continuously.

The installation 10 advantageously comprises a multiple-way valve 30 which allows the hermetic cell 14 to communicate with different auxiliary equipment. A first port A of this valve 30 is connected for example to a three-way valve 32, itself connected to a reservoir 34 containing the radioisotope precursor and to a pipetting device 36 e.g. a syringe. A second port B is connected to a first port of the hermetic cell 14 via a duct 38 intended for filling and draining of the hermetic cell 14. A third port C is connected to a vessel 40 intended to receive the irradiated product when irradiation is completed. A fourth port D is connected to an overflow container 42 intended to collect excess fluid injected into the hermetic cell 14. A fifth port E is connected to a second port of the hermetic cell 14 via a duct 44. This duct 44 is used to evacuate the excess fluid injected into the hermetic cell and to add purge gas to the hermetic cell 14 respectively. This purge gas is contained in a reservoir 46 connected to a sixth port F.

The control device 28 controls the different valves 30, 32, the pipetting device 36, the cooling device 16, the flow rate of the purge gas bottle 46 and the particle accelerator 18. During the filling of the hermetic cell 14, the valve 30 connects port A with port B and port D with port E. The three-way valve 32 connects the reservoir 34 containing the radioisotope precursor with the pipetting device 36 which draws a quantity of fluid containing the radioisotope precursor. The three-way valve 32 then connects the pipetting device 36 with port A of the valve 30. The pipetting device 36 is then able to inject the fluid containing the radioisotope precursor into the hermetic cell 14, any excess fluid being evacuated towards the overflow container 42. When the hermetic cell 14 is filled, the valve 30 closes all the ports and the accelerator 18 produces the beam to irradiate the target 12. When irradiation of the target 12 is completed, the valve 30 connects port F with port E, and port B with port C, so that the purge gas can be injected into the hermetic cell 14, and the irradiated fluid can be evacuated from the target 12 to be collected in the vessel for the irradiated product 40.

It is to be noted that during the irradiation operation of the target 12, the internal pressure (P) is freely left to set itself up inside the hermetic cell 14. This means that there is no need for a device to regulate the internal pressure inside the hermetic cell 14, based on a pressurising system using a pressurising gas and a depressurising system using a purge valve.

The internal pressure (P) inside the hermetic cell 14 is measured by the pressure sensor 24 and monitored by the control device 28. When the internal pressure (P) moves out of a first defined tolerance range, the controller 28 simply interrupts irradiation of the target 12 or reduces the intensity thereof. It is noted that, for a given target 12, this first tolerance range is defined specifically for the current intensity I of the beam 20, the volume V of radioisotope precursor fluid contained in the hermetic cell 14 and the cooling power of the target 12. (Normally, the cooling power is maintained constant).

The control device 28 is therefore programmed to interrupt the irradiation of the target 12 when the internal pressure (P) in the hermetic cell 14 moves out of a first defined tolerance range. It is advantageously programmed to trigger a previous alarm and/or to reduce the intensity of irradiation when the internal pressure (P) of the hermetic cell 14 moves out of a second determined tolerance range which is included within the first tolerance range.

One advantageous definition of these tolerance ranges will now be described with reference to FIG. 2 which in particular gives an experimental curve P=f(I) representing changes in internal pressure (P) inside the hermetic cell 14 as a function of beam current intensity (I), for a given target 12, a certain volume of radioisotope precursor fluid in the hermetic cell 14 and a certain cooling power of the target 12. The example of the curve P=f(I) illustrated in FIG. 2 was determined for example for a hermetic cell 14 of given geometry, having a volume of 3.5 ml, filled with a volume of 2.5 ml of radioisotope precursor fluid. To record this curve P=f(I) the beam intensity was gradually increased, measuring the internal pressure of the target using a pressure sensor 24. These measurements were performed until the nominal pressure value was reached (Pmax) guaranteed for the target 12 for a beam current intensity I of about 60 μA. Throughout all these measurements the flow rate of cooling liquid was maintained substantially constant, as was the input temperature of the cooling liquid into the target 12.

Figure 2:
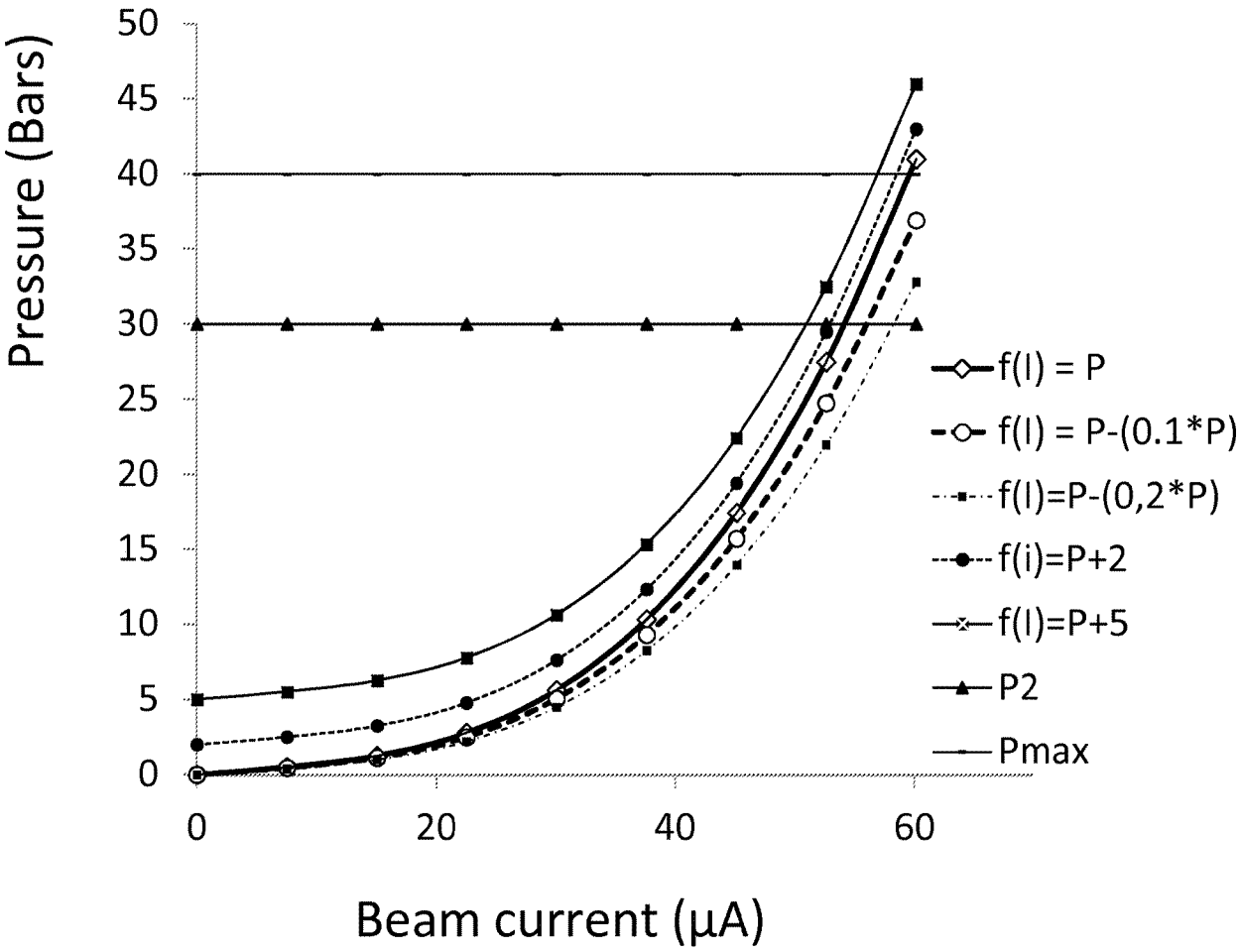
FIG. 2: is a graph showing an experimental curve P=f(I) illustrating the trend in internal pressure as a function of beam intensity (I), and curves of internal pressure tolerance ranges for a target of given geometry, a given cooling power and a given volume of radioisotope precursor.

It will be noted that the curve P=f(I) illustrated in FIG. 2 is not limiting for the invention. The curve P=f(I) varies in relation to the quality of the beam produced by the accelerator, the geometry of the target, cooling power, the volume and type of radioisotope precursor fluid. The curve P=f(I) can also be determined theoretically by simulation taking into account parameters of the beam, of the volume of radioisotope precursor fluid, the power of the cooling system, the geometry of the target 1 and the characteristics of the radioisotope precursor fluid.

The first tolerance range has a lower pressure limit and a higher pressure limit, both defined for the said given beam current intensity (I) on the basis of the curve P=f(I). The lower limit of internal pressure is defined so that it is preferably between 5% and 20% lower than the pressure value inferred from the curve P=f(I) for the given beam current intensity (I). In FIG. 2, the curve f(I)=P−(0.2*P) represents the case for example in which a lower internal pressure limit is defined so that it is 20% lower than the pressure value inferred from the curve P=f(I) for a given beam current intensity (I). The upper limit of internal pressure is a pressure between the pressure value inferred from the curve P=f(I) for the given beam current intensity and a nominal pressure value (Pmax) of the hermetic cell. It is advantageously between 5 and 10 bars higher than the pressure value inferred from the curve P=f(I) for a given beam intensity (I), and its ceiling is a pressure value (P2) lower than the nominal pressure value (Pmax) of the hermetic cell 14. The curve f(I)=P+5 in FIG. 2 represents the case for example in which an upper limit of internal pressure is determined so that it is 5 bars higher than the pressure inferred from the curve P=f(I) for a given beam intensity (I). In FIG. 2, the upper limit of internal pressure is preferably fixed at a value P2=30 bars, which represents 75% of the nominal pressure Pmax and is equal to 40 bars.

The second tolerance range is included in the first tolerance range and is also positioned around the curve f(I)=P. The lower limit of internal pressure in the second tolerance range is defined so that it is lower, preferably at least 2% lower, than the pressure value inferred from the curve P=f(I) for the given beam intensity (I), whilst remaining higher than the lower limit of internal pressure in the first tolerance range. The upper limit of internal pressure in the second tolerance range is determined so that it is higher than the pressure value inferred from the curve P=f(I) for the given beam intensity (I) whilst remaining lower than the upper limit of internal pressure in the first tolerance range.

An example of a second tolerance range is also illustrated in FIG. 2. The lower limit of internal pressure is illustrated by the curve f(I)=P−0.1*P) and the upper limit of internal pressure is illustrated by the curve f(I)=P+2.

The control device 28 which also controls the intensity of the beam current is advantageously programmed to cause a reduction in the intensity of the beam current when the internal pressure (P) in the hermetic cell 14 exceeds an upper limit of internal pressure. This upper limit is then defined so that it is higher than the pressure value inferred from the said curve P=f(I) for the given beam current intensity (I) but lower than the upper limit of internal pressure in the said first tolerance range.

To optimise the method it is possible in particular to act on the extent of filling of the hermetic cell 14. To optimise the radioisotope production yield, it is useful to optimise the extent of filling of the hermetic cell. With knowledge of the nominal pressure value (Pmax) of the hermetic cell, whilst measuring the internal pressure of the hermetic cell, the target is irradiated with a beam current I for a defined period (e.g. two hours) with different volumes of radioisotope precursor fluid, so as not to exceed the nominal pressure (Pmax). The yield of radioisotope production for each of the volumes is then calculated. A yield curve of radioisotope production is plotted as a function of the extent of filling of the cell which in practice displays a constant yield over and above a critical volume filling, and a sharp drop in yield below this same critical volume filling. To minimise pressure constraints in the target whilst minimising the tunnelling effect, a volume filling of the hermetic cell is fixed which corresponds to this critical volume filling or to a slightly higher volume filling, and the pressure curve P is determined either experimentally or theoretically as a function of the beam current intensity I for this extent of volume filling of the hermetic cell.

It remains to be noted that the described installation and method are particularly adapted for the production of radioisotopes such as $^{11}C$, $^{13}N$, $^{15}O$ or $^{18}F$.

LIST OF REFERENCE NUMBERS

10 radioisotope production installation
12 target
14 hermetic cell
16 cooling circuit
18 particle accelerator
20 particle beam
22 beam window
24 pressure sensor
26 data bus
28 control device
30 multi-way valve
32 three-way valve
34 reservoir containing radioisotope precursor
36 pipetting device
38 duct
40 vessel to receive irradiated product
42 overflow container
44 duct
46 reservoir with purge gas

The invention claimed is:

1. A method for producing a radioisotope, comprising:

irradiating a given volume of radioisotope precursor fluid contained in a hermetic cell of a target, using a beam of particles of given beam current intensity (I) which is produced by a particle accelerator;

cooling said target using a given cooling power; and measuring the internal pressure (P) inside said hermetic cell, wherein:

during irradiation, the internal pressure (P) inside said hermetic cell is allowed to freely evolve within a first pressure tolerance range, wherein said first pressure tolerance range is determined as a function of different parameters having an influence on the evolution during irradiation of the internal pressure inside said hermetic cell, said parameters comprising, for a given target, a given beam of particles and a given radioisotope precursor fluid, the given volume of the radioisotope precursor fluid contained in said hermetic cell, the given cooling power used for cooling said target and the given beam current intensity (I); and irradiation is interrupted or its intensity reduced when the internal pressure (P) in said hermetic cell moves out of said first internal pressure tolerance range, wherein a curve P=f(I) is defined giving the internal pressure (P) of said hermetic cell at different beam current intensities (I), for a given volume of radioisotope precursor fluid and a given cooling power used for cooling said target;

said first internal pressure tolerance range has a lower pressure and an upper pressure limit defined for said given beam current intensity (I) based on said curve P=f(I);

said lower limit of internal pressure is defined so that it is lower than the pressure value inferred from said curve P=f(I) for said given beam current intensity (I); and said upper limit of internal pressure is a pressure between the pressure value inferred from said curve P=f(I) for said given beam current intensity and a nominal pressure value (Pmax) of said hermetic cell, said nominal pressure value (Pmax) being the maximum operating pressure for which said hermetic cell has been designed.

2. The method according to claim 1 wherein said upper limit of internal pressure in said first internal pressure tolerance range is lower by at least 20% than said nominal pressure value (Pmax) of said hermetic cell.

3. The method according to claim 1 wherein said upper limit of internal pressure in said first internal pressure tolerance range is between 5 and 10 bars higher than the pressure value inferred from said curve P=f(I) for said given beam current intensity (I) and its ceiling is a pressure value (P2) that is lower than said nominal pressure value (Pmax) of said hermetic cell.

4. The method according to claim 1 wherein a control device triggers an alarm when the internal pressure (P) in said hermetic cell moves out of a second internal pressure tolerance range defined as a function of different parameters having an influence on changes in internal pressure in said hermetic cell during irradiation, said second tolerance range being included within said first tolerance range.

5. The method according to claim 4 wherein:

said second internal pressure tolerance range has a lower pressure limit and a higher pressure limit defined on the basis of said curve P=f(I);

said lower pressure limit of said second tolerance range is defined so that it is lower than the pressure value inferred from said curve P=f(I) for the given beam current intensity (I) whilst remaining higher than said lower pressure limit of said first internal pressure tolerance range; and said upper pressure limit of said second internal pressure tolerance range is defined so that it is higher than the pressure value inferred from said curve P=f(I) for the given beam current intensity (I) whilst remaining lower than said upper pressure limit of said first internal tolerance range.

6. The method according to claim 1 wherein, when the internal pressure (P) in said hermetic cell exceeds an upper limit of internal pressure fixed inside said first internal pressure tolerance range, the beam current is decreased.

7. The method according to claim 1 wherein the given volume of the radioisotope precursor fluid contained in said hermetic cell is optimised experimentally for a range of envisaged beam currents.

8. The method according to claim 1 wherein said radioisotope precursor is a precursor of $^{11}C$, $^{13}N$, $^{15}O$ or $^{18}F$.

9. An installation for implementing the method according to claim 1, comprising:

a target with a hermetic cell capable of containing a given volume of precursor fluid, said hermetic cell being designed to withstand a nominal pressure (Pmax);

a particle accelerator capable of producing and directing a beam of accelerated particles of a given beam current intensity (I) onto said target and of irradiating a given volume of the radioisotope precursor fluid contained in the hermetic cell of the target;

a system to monitor the internal pressure (P) inside said hermetic cell;

a cooling device configured to cool said target using a given cooling power;

a control device programmed to interrupt or reduce said beam of particles when the internal pressure (P) inside said hermetic cell moves out of a first internal pressure tolerance range determined as a function of different parameters having an influence on changes in internal pressure in said hermetic cell during irradiation, said parameters comprising, for a given target, a given beam of particles and a given radioisotope precursor fluid, the given volume of the radioisotope precursor fluid contained in said hermetic cell, the given cooling power used for cooling said target and the given beam current intensity (I), wherein the control device is programmed with a curve P=f(I) giving the internal pressure (P) of said hermetic cell at different beam current intensities (I), for a given volume of radioisotope precursor fluid and a given cooling power used for cooling said target, and said curve P=f(I) is used by said control device to define said first internal pressure tolerance range as a function of beam current intensity (I), said first internal pressure tolerance range has a lower pressure and an upper pressure limit defined for said given beam current intensity (I) based on said curve P=f(I), said lower limit of internal pressure is defined so that it is lower than the pressure value inferred from said curve P=f(I) for said given beam current intensity (I), and said upper limit of internal pressure is a pressure between the pressure value inferred from said curve P=f(I) for said given beam current intensity and a nominal pressure value (Pmax) of said hermetic cell, said nominal pressure value (Pmax) being the maximum operating pressure for which said hermetic cell has been designed.

10. The installation according to claim 9 wherein said control device is programmed to trigger an alarm when the internal pressure in said hermetic cell lies outside a second range included within said first internal pressure tolerance range.

11. The installation according to claim 9 wherein said control device is programmed to cause a reduction in the intensity of the beam current when the internal pressure (P) in said hermetic cell exceeds an upper limit of internal pressure included in said first internal pressure tolerance range.

12. The method according to claim 1, wherein said lower limit of internal pressure is defined so that it is 5-20% lower than the pressure value inferred from said curve P=f(I) for said given beam current intensity (I).

13. The method according to claim 5, wherein said lower pressure limit of said second tolerance range is defined so that it is at least 2% lower than the pressure value inferred from said curve P=f(I) for the given beam current intensity (I) whilst remaining higher than said lower pressure limit of said first internal pressure tolerance range.

14. A method for producing a radioisotope, comprising:

irradiating a volume of radioisotope precursor fluid contained in a hermetic cell of a target, using a beam of particles of given current intensity which is produced by a particle accelerator;

cooling said target; and measuring the internal pressure inside said hermetic cell;

wherein:

a curve P=f(I) is determined giving the internal pressure (P) of the hermetic cell at different beam current intensities (I), for a given volume of radioisotope precursor fluid and a given power used for cooling said target;

a first internal pressure tolerance range has a lower pressure limit and upper pressure limit defined for said given beam current intensity (I) on the basis of said curve P=f(I);

a second internal pressure tolerance range has a lower pressure limit and a higher pressure limit defined for said given beam current intensity (I) on the basis of said curve P=f(I);

said lower pressure limit of said second internal pressure tolerance range is defined so that it is lower than the pressure value inferred from said curve P=f(I) for the given beam current intensity (I) whilst remaining higher than said lower pressure limit of said first tolerance range;

said upper pressure limit of said second tolerance range is defined so that it is higher than the pressure value inferred from said curve P=f(I) for the given beam current intensity (I) whilst remaining lower than said upper pressure limit of said first internal tolerance range;

said irradiation is interrupted or its intensity reduced when the internal pressure (P) in said hermetic cell moves out of said first internal pressure tolerance range; and a control device triggers an alarm when the internal pressure (P) in said hermetic cell moves out of said second internal pressure tolerance range.

* * * * *